United States Patent [19]

Roberts

[11] Patent Number: 4,717,212

[45] Date of Patent: Jan. 5, 1988

[54] SEWING MACHINE CABINET WITH POWER LIFT

[75] Inventor: Kent S. Roberts, American Fork, Utah

[73] Assignee: Roberts Mfg., Inc., American Fork, Utah

[21] Appl. No.: 419,820

[22] Filed: Sep. 20, 1982

[51] Int. Cl.[4] ..... A47B 46/00

[52] U.S. Cl. ..... 312/21; 312/312

[58] Field of Search ..... 112/217.1–217.4; 108/147; 312/21, 312; 293/348, 347; 248/422

[56] References Cited

U.S. PATENT DOCUMENTS

| | | | |
|---|---|---|---|
| 7,224 | 3/1850 | Searle | 297/347 |
| 2,679,283 | 5/1954 | Mahone | 297/348 |
| 3,215,469 | 11/1965 | Wamsley | 297/348 |
| 3,993,008 | 11/1976 | Parsons | 112/217.5 |
| 4,254,928 | 3/1981 | Huempfner | 108/147 X |

FOREIGN PATENT DOCUMENTS

| | | | |
|---|---|---|---|
| 175621 | 5/1935 | Switzerland | 108/147 |

*Primary Examiner*—Joseph Falk

*Attorney, Agent, or Firm*—Philip A. Mallinckrodt; Robert R. Mallinckrodt

[57] ABSTRACT

A sewing machine cabinet has a power lift operable by a rack and pinion type of mechanism whose pinion is driven by a reversible electric motor which preferably has incorporated therein braking means and speed reduction gearing. The rack is provided by one of a pair of guide columns, which is preferably indented along its length in sprocket formation. The pinion is preferably a sprocket wheel meshing with the sprocket indentations.

7 Claims, 6 Drawing Figures

SEWING MACHINE CABINET WITH POWER LIFT

BACKGROUND OF THE INVENTION

1. Field:

The invention is concerned with sewing machine cabinets having power lifts for raising and lowering the sewing machines relative to work tables of such cabinets.

2. State of the Art:

Many developments have been made in the past in sewing machine work tables and cabinets whereby a sewing machine can be effectively raised from a relatively low storage position below a work table to either a normal sewing position or to a free arm sewing position with respect to such work table. Most of these are manually operable, as typified by U.S. Pat. Nos. 2,738,248; Re. 28,835; and 4,135,463 to O. Berker, Kent S. Roberts et al., and Rejean Lacasse, respectively. However, one which has a power lift and has achieved significant commercial success is illustrated and described in U.S. Pat. No. 3,993,008 to Joe T. Parsons, Sr. It has a supporting platform for the sewing machine, which is mounted for up and down movement on a vertical, screw shaft rotated by a motor at the bottom of the shaft. Two cylindrical columns at respectively opposite sides of the screw shaft serve as guides for the shelf in its up and down movement, there being sleeves rigid with the shelf and slidable on such columns.

SUMMARY OF THE INVENTION

The present invention constitutes an improvement in a power lift sewing machine cabinet, such as that shown by the aforementioned Parsons U.S. Pat. No. 3,993,008. Normally, the sewing machine will be of free arm type necessitating two work positions for the sewing machine with respect to the work table of the cabinet.

It is highly desirable that the sewing machine be lifted from and lowered back to its storage position within the cabinet rapidly and without any possibility of stoppages by reason of binding of working components. It is also desirable that the working mechanism be not only reliable in operation, but be capable of manufacture at low cost.

In accordance with our invention, the object of which was to attain all of these desirable characteristics in a sewing machine cabinet having a power lift for the sewing machine, one of a pair of guide columns for the sewing-machine-receiving platform serves as a rack for a rack and pinion type of mechanism that preferably takes the form of sprocket-wheel-receiving indentations in such one guide column and a sprocket wheel adapted to walk up and down the indentations. The sprocket wheel, or other type of pinion if the column is a different type of rack, is carried by the platform on its underside, as is an electric motor equipped with speed-reduction gearing for driving the sprocket wheel and with braking means. We have found that this arrangement is economical, operationally effective, very rapid in response, and trouble-free in relation to the relatively heavy sewing machine that it must handle. The pinion is rotated slowly as compared to the threaded shaft in the Parsons device and provides desirable slow and steady ascent and descent for the sewing machine, enabling placement at any desired level. Although limit switches may be provided, they are not necessary with this arrangement.

THE DRAWINGS

An embodiment of sewing machine cabinet with power lift constituting the best mode presently contemplated for carrying out the invention in actual practice is illustrated in the accompanying drawings, in which:

FIG. 1 is a front elevational view of a typical sewing machine cabinet equipped with power lift in accordance with the invention, a part of an upper panel of the cabinet being broken away to show the sewing-machine-receiving platform and associated mechanism in a raised, free arm work position, with both the sewing machine and the lowered storage position of the platform and associated mechanism being indicated by broken lines;

FIG. 2, a view in horizontal section taken on the line 2—2 of FIG. 1;

FIG. 3, a left side, elevational view partly in transverse vertical section taken on the line 3—3 of FIG. 2;

FIG. 4, a fragmentary view in longitudinal vertical section taken on the line 4—4 of FIG. 3 and drawn to a considerably larger scale, an intermediate portion being broken away for convenience of illustration;

FIG. 5, a fragmentary view in horizontal section taken on the line 5—5 of FIG. 4 and drawn to the same scale; and FIG. 6, a fragmentary view in transverse vertical section taken on the line 6—6 of FIG. 4 and drawn to the same scale.

DETAILED DESCRIPTION OF THE ILLUSTRATED EMBODIMENT

In its illustrated form, the invention comprises a sewing machine cabinet 10 of known construction typical of commercial cabinets made to both store a free arm type of sewing machine 11 and to place it into either one of two possible work positions relative to the upper working surface **12*a* of a work table 12**, such work positions being well known to those familiar with this art.

Figure 3:
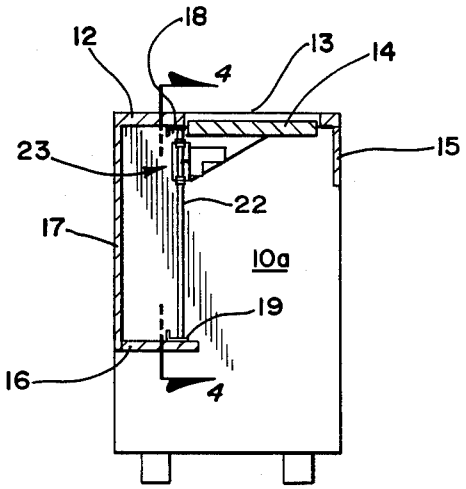
Figure 4:
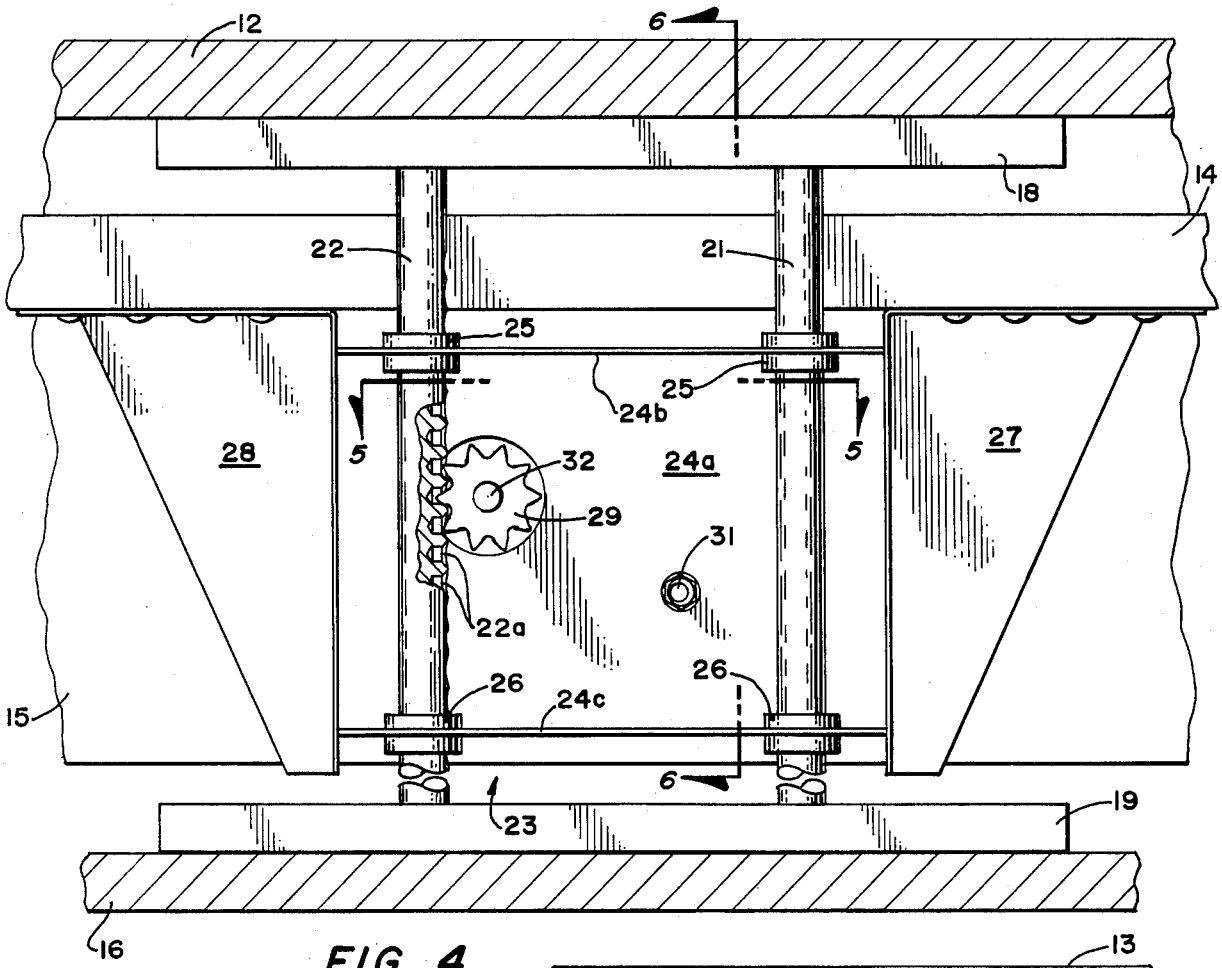
Figure 6:
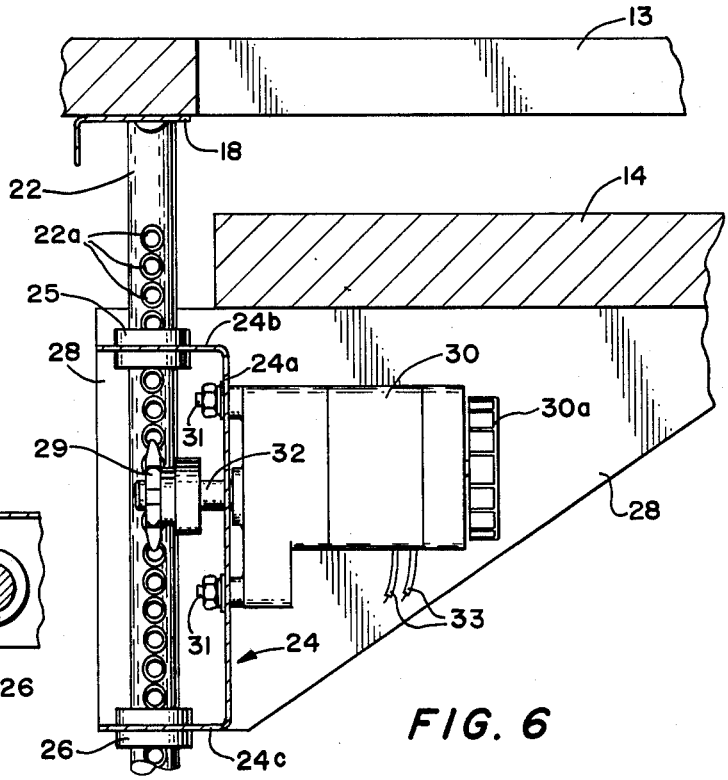

Work table 12 has an elongate platform-accommodating aperture 13 at some convenient location therein, for example, as illustrated in FIGS. 3 and 6, and a correspondingly elongate sewing-machine-receiving platform and a power lift assembly is mounted within cabinet 10 below such aperture.

The assembly comprises a platform 14 of shape and size adapted to receive an elongate sewing machine, such as the machine 11, to be stored within a central compartment **10*a* of cabinet 10 positioned between opposite end compartments 10*b* and 10*c*, which may be provided with drawers (not shown) in the usual manner. Platform 14 is desirably smaller than its receiving aperture 13** to leave peripheral space of about one-fourth of an inch all around as a protection against possible pinching of the fingers of the user.

As shown, central compartment **10*a* is open at the front below a panel 15, which extends only a short distance downwardly from work table 12 so the open front will accommodate the knees of one using the sewing machine when platform 14 is raised. A bottom panel 16 extends a short distance forwardly from rear panel 17** of the cabinet for supporting the platform and power lift assembly.

The power lift comprises mounting means in the form of a pair of elongate structural plate members 18 and 19 secured by any suitable means, such as screws 20, FIG.

2, to the underside of work table 12, as a top member, and to the upper face of bottom panel 16, as a bottom member, respectively. To and between these two members, are fixedly secured a pair of guide columns 21 and 22, which provide a path of up and down travel for platform 14. Mounted for up and down travel on such columns 21 and 22 is a carriage 23 which supports and carried platform 14.

Carriage 23 in this embodiment comprises a U-shaped plate 24, best shown in FIG. 6, arranged such that its web 24*a* stands vertically with its legs extending horizontally, one leg, 24*b*, being upper and one, 24*c*, being lower. Guide columns 21 and 22 extend through such legs, there being upper and lower sets of sleeves 25 and 26, respectively, affixed to such legs as slide bearings closely encircling the columns.

Figure 2:
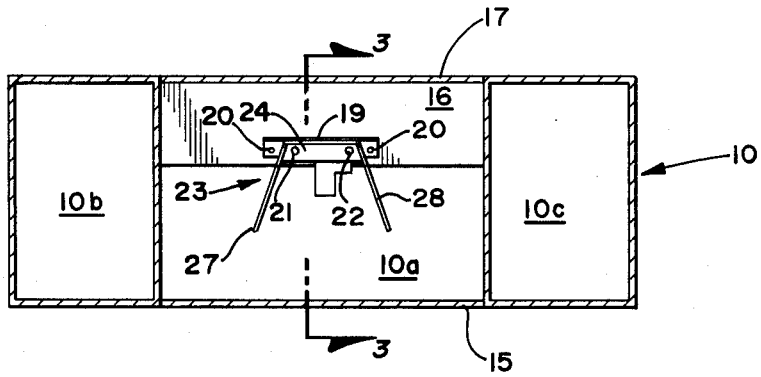

For receiving and supporting platform 14, a pair of wing members 27 and 28, respectively, are secured to opposite lateral sides of plate 24, as by welding when the plate and the wings are of sheet metal as is usual. Advantageously, such wing members diverge as they extend outwardly from their securement to plate 24, see FIG. 2.

For raising and lowering carriage 23 and holding it in a selected position relative to work table surface 12*a*, one of the guide columns, here column 22, is formed as a rack for engagement by a pinion, which is rotated by a suitable reversible power means that is conveniently provided with braking mechanism.

Figure 5:
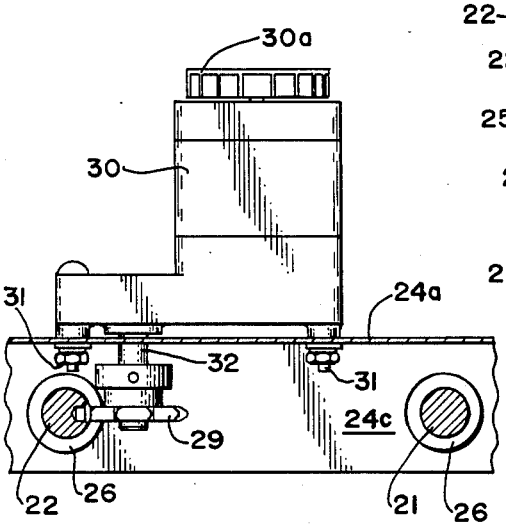

In the illustrated preferred form, guide column 22 is provided along its length with indentations 22*a* collectively forming a rack of sprocket formations, and the pinion is in the form of a sprocket wheel 29. The power means is a reversible electric motor 30, preferably of a commercial type, such as one produced by Merkle-Korff Industries, Des Plaines, Illinois, Catalogue No. QFS 12 3420, which is equipped with both speed reduction gearing and a braking mechanism (not shown as such), and which may have a cooling fan 30*a*. Electric motor 30 is fastened to the outside face of the web 24*a* of U-shaped plate 24 by bolts 31 and has its power output shaft 32, FIGS. 5 and 6, extending through a receiving opening in such web to mount sprocket wheel 29 on its free end for rotation at the opposite face of the web.

Figure 1:
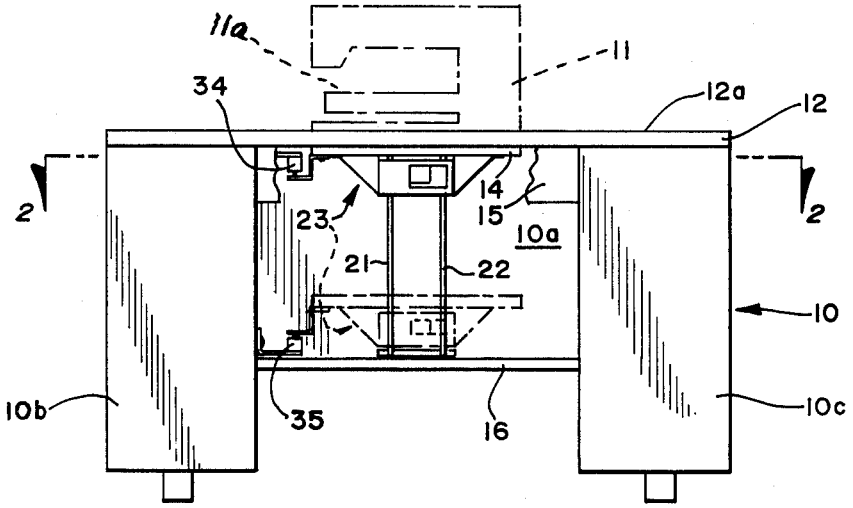

As so mounted, the electric motor and associated mechanism ride up and down with plate 24 as part of carriage 23. Electrical leads 33, FIG. 6, adapted for connection with any suitable source of electric power, provide sufficient slack to accommodate travel of carriage 23. Suitable electrical circuitry (not shown), which may be as disclosed in the afore-referred-to Parsons U.S. Pat. No. 3,993,008, including upper and lower limit switches 34 and 35, FIG. 1, for cutting off power to motor 30 at the upper and lower termination of carriage travel. However, in view of the slow and steady ascent and descent of platform 14 and the fact that the preferred motor is equipped with so-called "thermal protection", limit switches are not necessary and are preferably not provided.

As shown in FIG. 3, platform 14 is stopped somewhat below a position flush with the working surface 12*a* of the cabinet. However, it should be realized that it could be raised to flush position and stopped at any intermediate position between that and a completely lowered storage position within the cabinet. Ordinarily, with a free arm sewing machine, the platform will be stopped so that the upper surface 11*a* of the free arm is flush with the working surface of the cabinet for usual sewing tasks.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. In a sewing machine cabinet having a work table elongately apertured, an elongate sewing-machine-receiving platform accommodated by the aperture of the work table, and a power lift assembly for lowering and raising the platform from and back into the aperture, the improvement wherein the power lift assembly comprises a pair of guide columns, but only a pair, secured to the cabinet at and mutually spaced along one of the elongate sides of the platform intermediate the length thereof, one of said guide columns, but only one, being provided with a rack formation along its height, said power lift assembly further comprising a carriage mounting the platform, a pinion rotatably mounted on said carriage below the platform in operative engagement with the said rack formation of said one guide column for walking up and down the rack formation thereof when rotated in opposite directions, respectively; reversible power means mounted in said carriage for rotating said pinion; means for holding the carriage in selected positions along its path of travel; and means for controlling operation of said power means, said rack formation and said pinion being the sole power lift associated with the said pair of guide columns.

2. The improvement of claim 1, wherein the rack formation of the one guide column comprises sprocket formations along the length of the one column, and the pinion is a sprocket wheel adapted to walk up and down said sprocket formations.

3. The improvement of claim 2, wherein the sprocket formations are indentations in the one guide column.

4. The improvement of claim 1, wherein the reversible power means for rotating the pinion comprises a reversible electric motor, and speed reduction gearing between said motor and the pinion.

5. The improvement of claim 4, wherein the reversible power means for rotating the pinion also comprises braking means for the motor as the means for holding the carriage in selected positions.

6. The improvement of claim 1, wherein the carriage comprises a pair of legs extending from opposite ends of a web to form a U-shaped plate, a pair of platform-supporting wing members secured to opposite ends of said plate, the guide columns extending through the legs of said plate, sleeve members carried by said legs of the plate and slidably encircling the respective guide columns, both the pinion and the rotating means being carried by the web of said plate on opposite faces thereof, the pinion being on the inner face between said legs of the plate.

7. The improvement of claim 6, wherein there are elongate structural plate members at and extending across the tops and bottoms of the guide columns, means fastening the top plate member to the underside of the work table marginally of the platform-accommodating aperture, and means fastening the bottom plate member to a lower part of the cabinet so that the guide columns stand vertically.

* * * * *